United States Patent [19]

Hoffman

[11] Patent Number: 4,721,197

[45] Date of Patent: Jan. 26, 1988

[54] VENDING MACHINE

[76] Inventor: Arlan Hoffman, 5137 Coldbrook Dr., Mantua, Ohio 44255

[21] Appl. No.: 832,077

[22] Filed: Feb. 24, 1986

[51] Int. Cl.[4] ..... G07F 5/02

[52] U.S. Cl. ..... 194/235; 194/253; 194/345; 194/346; 194/343; 221/92; 221/133; 221/151; 221/195; 221/210

[58] Field of Search ..... 221/123, 133, 151, 152, 221/191, 210, 211, 255, 92, 154, 194, 195, 239, 262, 268, 126, 127, 259; 194/235, 253, 345, 346, 343

[56] References Cited

U.S. PATENT DOCUMENTS

| | | | |
|---|---|---|---|
| 1,714,631 | 5/1929 | Rowe | 194/346 X |
| 1,758,390 | 5/1930 | Curtis | 194/235 X |
| 2,094,433 | 9/1937 | Sharp | 221/210 X |
| 2,799,430 | 7/1957 | Kintzel | 221/123 X |
| 2,885,112 | 5/1959 | Willat | 221/210 X |
| 4,401,233 | 8/1983 | Frey | 221/210 X |
| 4,417,670 | 11/1983 | Booher | 221/210 |

FOREIGN PATENT DOCUMENTS

| | | | |
|---|---|---|---|
| 43499 | 4/1977 | Japan | 221/129 |

*Primary Examiner*—Joseph J. Rolla
*Assistant Examiner*—David H. Bollinger
*Attorney, Agent, or Firm*—Oldham, Oldham & Weber Co.

[57] ABSTRACT

A manually operated coil vending machine device is described which has a rod tipped with a pressure sensitive adhesive movable along a slot in the device to a storage bin area where articles for sale are stored and displayed. Once in the bin area, the rod is lowered until it sticks to the article selected, after which the rod is raised and moved back along the slot until it reaches an area accessible to the operator-purchaser. At such point, the purchased article is grasped and removed. The device can only be operated after predetermined coins equal to the purchase price of the articles have been inserted in the device, thereby permitting removal of a rod blocking first projection over the slot by pressure of the rod as it moves along the slot to the storage bin area. On its return to the accessible area, pressure of the rod against a rod blocking second projection over the slot removes the latter projection, and simultaneously returns the first projection to its blocking position over the slot, barring further entry to the storage bin area until additional coins have been inserted.

5 Claims, 11 Drawing Figures

VENDING MACHINE

TECHNICAL FIELD

The invention is directed to a vending machine for dispensing small articles to purchasers. More specifically, the invention is directed to a coin operated vending machine which dispenses small packaged articles such as, for example, candy bars, after coins equal to the purchase price of the articles are inserted into the machine.

BACKGROUND ART

Coin operated dispensing or vending machines have been known and used for a very long time. Such machines are commonly employed to dispense soft drinks, chewing gum, candy bars and a myriad of other products too numerous to mention. The machines come in many shapes and sizes; they are operated by a variety of mechanical, electrical and mechano-electrical mechanisms and principles, and they continually grow more sophisticated and complex.

As is well known, however, coin operated vending machines, particularly those operated with complicated and intricate electrically driven mechanisms, frequently break and become inoperable. When this occurs, the machines generally have provision for returning the would-be purchaser's money. Even when the coin return mechanism works, however, the disfunction leaves a disappointed customer, and of course the machine remains inoperable until it is repaired. Usually such repairs can only be accomplished by a skilled person who is often not immediately available. Furthermore, the repair process is expensive, and the period during which the machine is inoperable is costly, since no revenue is generated from the articles which ordinarily would have been dispensed during such period.

While there is undeniably a market for the more complicated machines, many of those wishing to vend articles to customers have a need for vending machines far simpler in design than those generally available today. The instant invention fills this need by providing a vending machine which is both simple and inexpensive. The vending machine of the invention is easily operated by a would be purchaser, and is durable and relatively trouble-free. However, should the machine become inoperable for any reason, it can easily be disassembled, repaired, and serviced by an individual having no specialized skills or training. Importantly, the machine of the invention is relatively small, light, and portable, making a change in location easily accomplished if desired.

BRIEF DESCRIPTION OF THE INVENTION

These and other desirable characteristics, as will be evident from the remainder of the specification, are achieved in a vending machine device which comprises:

- a plurality of bins in which the articles to be sold are securely stored,
- retrieval means for transferring the stored articles from such bins to an area accessable to the purchaser, and
- retrieval release means which allows the retrieval means to be engaged when the predetermined coins are inserted in the coin receiver operably attached thereto.

In a preferred embodiment, the retrieval means consists of a rod which has an adhesive substance disposed on its lower end, thereby allowing the rod to adhere to stored objects with which it comes in contact in the bins.

In the illustrative embodiment, a retrieval means is provided which consists of a rod having a pressure sensitive adhesive affixed to its lower end, and a graspable knob or handle on its upper end. When the predetermined coins are inserted in the coin receiver of the device, the rod, which is raised to an upper position high enough to be moved over the bin partitions, can be moved along a rod slot past a retrieval release mechanism to the bin where the article selected for purchase is stored. When the rod is in position over such bin, the rod is lowered so that the adhesive on its lower end contacts and adheres to the article. The rod is then raised with the article adhering to it to the rod's upper position, and moved back over the bin partitions, past the retrieval release mechanism, to a position over an area, the lower section of which is accessable to the purchaser. The rod is then lowered so that its lower end is adjacent to the accessable section, thus allowing the article to be removed by the purchaser.

The coin receiver, which is operably connected to the retrieval release mechanism, has both a blocking and an unblocking position, and by virtue of its connection to the retrieval release mechanism, either permits or prevents movement of the rod past such mechanism to the bin storage area. In its unblocked position, for example, the receiver is capable of lateral movement so that retrieval release mechanism connected thereto can be moved by pressure of the rod into a non- obstructing position, permitting movement of the rod past the mechanism into the bin storage area. As the coin receiver is laterally moved, the coins stored therein are moved over, and free to drop into a coin storage area. As the rod carrying the purchased merchandise is moved back toward the accessable area, it again contacts the retrieval release mechanism and in passing it moves the mechanism, and therefore the coin receiver, back into the receiver's blocking position.

Blocking is achieved through movable blocking bars, which in their blocking position engage blocking shoulders in the coin receiver, preventing its lateral movement.

The unblocking configuration occurs when the proper coins are inserted in the coin receiving slots. The curved periphery of the coins permits the movable blocking bars to ride up over the blocking shoulders as the retrieval release mechanism connected to the coin receiver is laterally moved by pressure of the rod against the mechanism. The retrieval release mechanism connected thereto is consequently free to move into its non-rod obstructing position, allowing the rod to pass into the bin storage area. As the coin receiver completes its movement, the contained coins are released from the receiver into the coin storage area. When the rod is moved back with the purchased merchandise, again contacting the retrieval release mechanism, the coin receiver is also moved back as a result of its connection to the mechanism, and the blocking bars again drop into engaging contact with the blocking shoulders due to the absence of the coins, thereby preventing movement of the rod back into the bin storage area.

BRIEF DESCRIPTION OF THE DRAWINGS

This invention will be better understood when taken in conjunction with the drawings wherein.

BEST MODE FOR CARRYING OUT THE INVENTION

Figure 1:
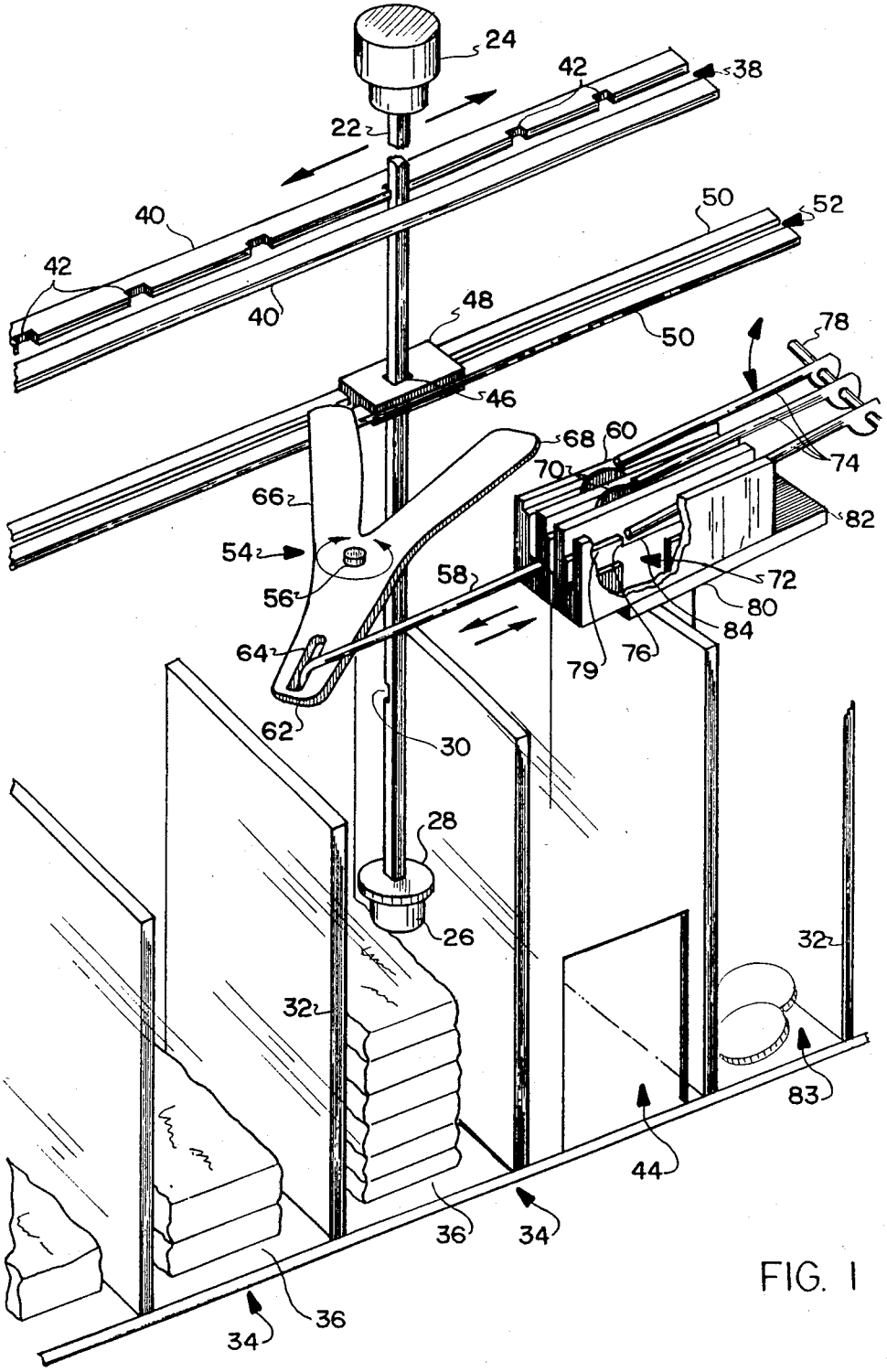
FIG. 1 is a perspective view of the relative position of many of the parts of the vending machine of the invention.

FIG. 1 shows many of the features of the invention in representational relativity to better illustrate their working relationship with each other. The features shown are embodied in parts, which together with the other parts described herein, are fastened together and housed in any of the ways well known in the art. In FIG. 1, rod 22 is shown comprising a knob 24 at its upper end, and an adhesive pad 26 attached to disc 28 at its lower end. Rod 22 is fitted with a notch 30 which holds rod 22 in an upper position on rails 40 when it is being laterally moved. This permits the adhesive pad 26 on the lower end to be maintained in a position high enough to pass over the bin partitions 32 of the storage bins 34, where the articles 36 to be purchased are stored.

To operate the device, rod 22 is moved laterally along transfer slot 38, which is formed between rails 40. At intervals along one of the rails 40 there are located a number of cut-outs 42 of a size sufficient so that the area of the cut-out 42, together with the area of the adjacent slot 38, is large enough to accomodate the cross sectional area of rod 22. The cut-outs 42 are located above each of the storage bins 34 so that when rod 22 encounters a cut-out, it can be lowered into a storage bin 34 to allow the adhesive pad 26 to be brought into adhering contact with the article 36 to be purchased. After the article 36 is contacted and securely adhered to pad 26, rod 22 is raised until the notch 30 in rod 22 again reaches the rails 40, at which point the notch 30 is capable of re-engaging one of the rails 40. The rod 22 can then be moved laterally until it reaches the cut-out 42 located over the accessable area 44. At this point, rod 22 is lowered through the cut-out 42 to the section of the accessable area 44 where the purchaser can grasp and detach the article purchased.

The placement of rod 22 in the device of the invention is such that it passes through hole 46 in guide block 48. Guide block 48 is adapted to slide along rails 50, forming rod slot 52, and serves the purpose of maintaining rod 22 in a substantially vertical position, thereby helping to guide its movements, both vertically and laterally.

The retrieval release mechanism 54, which is designed to limitedly rotate in either direction around pivot point 56 as shown by the adjacent arrows, determines whether the rod 22 is free to travel down rod slot 52 into storage bins 34 where the articles 36 for sale are stored. Rotation of the retrieval release mechanism 54 is controlled by connecting hook 58, attached to coin receiver 60. The hook is slidably connected to arm 62 through hook slot 64. When coins of the proper denomination are inserted in the coin receiver 60, which is shown with one of its sides partially cut away for clarity, the coin receiver is free to slide to the right as shown by one of the adjacent arrows. Projecting arm 66 of the retrieval release mechanism 54 can thus be rotated in a counterclockwise direction around the mechanism 54 pivot point 56 far enough so that the arm no longer obstructs the travel of the rod along rod slot 52 into the storage bin 34 area. When rod 22 travels in the reverse direction in the process of retrieving an article 36, it again encounters the retrieval release mechanism 54 and contacts projecting arm 68 which was rotated over rod slot 52 at the same time arm 66 was rotated out of the way during travel of rod 22 to the storage bin 34 area. As projecting arm 68 is contacted, it rotates the retrieval release mechanism 54 in a clockwise direction, moving projecting arm 68 out of the way, thereby allowing rod 22 to reach purchaser accessable area 44. As projecting arm 68 moves out of the way, projecting arm 66 again moves over and obstructs rod slot 52, resetting the retrieval release mechanism 54 in its obstructing mode.

Whether the coin receiver 60 is free to move so as to allow the retrieval release mechanism 54 to function as described depends on whether coins 70 of the proper number and denomination have been inserted in coin slots 72 of the coin receiver 60. In the absence of such coins 70, movement of the coin receiver 60 to the right in FIG. 1 so as to permit counterclockwise rotation of the release mechanism 54 is prevented by engagement, for example, of movable bars 74 against blocking shoulders 76. When coins 70 of the proper denomination are inserted in the coin slot 72, however, the movable bars 74, which are free to rotate about axle 78, are forced to follow the perimeters of the coins 70, riding up and over blocking shoulders 76 and onto upper ledges 79. This allows the movable bars 74 to avoid contact with the blocking shoulders 76, allowing coin receiver 60 to travel to the right in FIG. 1, thereby permitting the release mechanism 54 to rotate counterclockwise. Coin receiver 60 continues its travel to the right over the surface of retaining block 80, the latter block serving both as a guide for the coin receiver and as a device to retain the coins 70 in their respective coin slots 72. At the end of the travel of coin receiver 60 to the right, the coin slots 72 pass the edge 82 of the retaining block 80. This allows the coins 70 to fall through the coin slots 72 and into the coin collection bin 83. As the coins 70 fall from the coin receiver 60, moveable bars 74 fall onto lower ledges 84 where they again engage blocking shoulders 76 if rod 22 movement to the storage bin area is reattempted without reinserting the proper coins 70.

Figure 2:
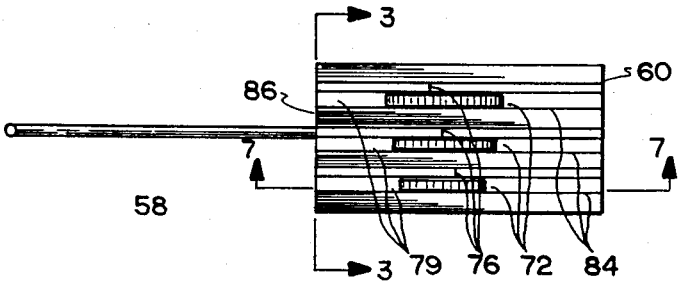
FIG. 2 is a plan view of the coin receiver.

FIG. 2 is a top plan view of coin receiver 60 showing details of the retrieval release mechanism engaging hook 58. Although the hook is shown attached to the center of coin receiver face 86 of FIG. 2, its precise position may be varied as desired, as may its exact configuration, it only being necessary that it form a connecting link between the retrieval release mechanism 54 of FIG. 1 and coin receiver 60.

The coin slots 72 are provided in number and size, i.e., height, width, and length, sufficient to accomodate coins 70 equaling the purchase price of the articles for sale. Advantageously, the blocking shoulders 76 are high enough so that the tops of the coins 70 inserted in coin slots 72 are at the same height as the top of the blocking shoulder, although the top of the blocking shoulders may be lower than the tops of the coin if desired. In other words, the height of the upper ledges 79 should be no higher than the diameters of the inserted coins. The height of lower ledges 84 may also be varied, it only being necessary that they be at least one-half the diameter of the inserted coins 70, preferably slightly higher, in order that the movable bars 74 of FIG. 1 will not be blocked by the coins during attempted movement of coin receiver 60, but rather will ride up and over their perimeter onto upper ledges 79 so as to avoid blocking engagement with blocking shoulders 76.

The coin receiver 60 may be made from any suitable material such as for example plastic or metal; however, metal is preferred since it is less prone to wear. The price of the articles 36 may be changed simply by exchanging the original coin receiver for another having different numbers and/or sizes of coin slots 72. Alternatively, some of the coin slots 72 may be blocked by inerting a suitably shaped wedge therein.

Figure 3:
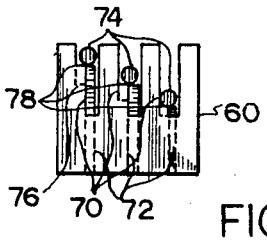
FIG. 3 is a transverse section 3—3 of FIG. 2 showing coins in the coin receiver, and the blocking bars in their unblocking position.

FIG. 3 is a sectional end view 3—3 of FIG. 2 coin receiver 60 showing the coins 70 disposed in coin slots 72. Also shown are the blocking shoulders 76, and the movable bars 74 which in the view shown have riden up on the perimeter of the coins, past the blocking shoulders as the coin receiver 60 has been moved toward the viewer, and rest on upper ledges 79.

Figure 4:
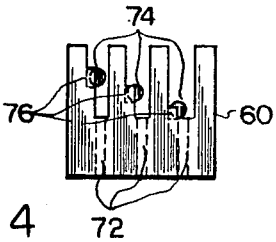
FIG. 4 is a transverse section 3—3 of FIG. 2 showing no coins in the coin receiver, and the blocking bars in their blocking position.

FIG. 4 is also a sectional end view 3—3 of FIG. 2 of coin receiver 60 in which, however, no coins have been inserted in coin slots 72. Consequently, as movement of the coin receiver 60 has been attempted, movable bars 74 have traveled along lower ledge 84, as shown in FIG. 2, as the receiver has been moved away from the viewer until they have contacted blocking shoulder 76. No further movement in such direction is, therefore, possible, and the attached retrieval release mechanisms 54 remains as an unpassable obstruction to the travel of rod 22 to the storage bin 34 area.

Figure 5:
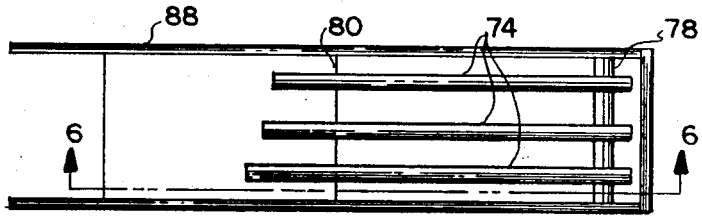
FIG. 5 shows a plan view of the coin receiver receptacle assembly.

FIG. 5 is a plan view of the coin receiver receptacle assembly 88, which advantageously can be provided to guide the back and forth travel of coin receiver 60. In addition, it conveniently serves as a support for axle 78 on which moveable bars 74 are located, the bars being free to move up and down as shown by the adjacent arrows in FIG. 1. The receptacle assembly 88 may also serve as a support for retaining block 80, which as aforesaid serves the purpose of temporarily holding the coins 70 in their respective coin slots 72, thereby permitting the vending device to be successfully operated. Variations in the design of the receptacle assembly 88 are obviously possible, it only being necessary that guidance of the coin receiver 60 in its back and forth travel be accomplished, and that support means for axle 78 and retaining block 80 be provided in the vending device.

Figure 6:
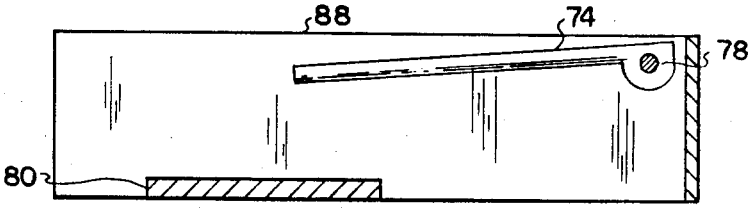
FIG. 6 is a front transverse section through 6—6 of FIG. 5.

FIG. 6 is a sectional side view 6—6 of the receptacle assembly 88 of FIG. 5 showing details of the moveable bars 74, the mounting of axle 78, and the positioning of block 80.

Figure 7:
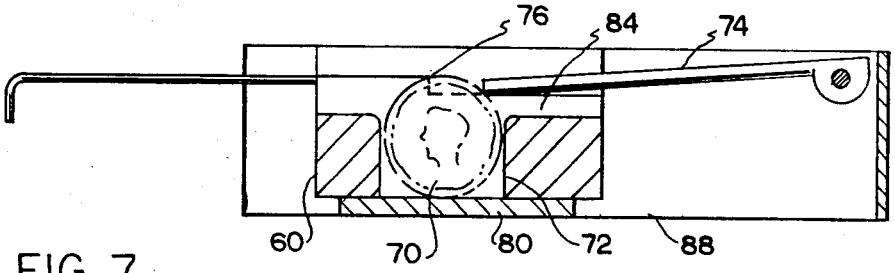
FIG. 7 is a front transverse section 7—7 of the coin receiver of FIG. 2 located in the coin receiver receptacle assembly of FIG. 6.

FIG. 7 is a sectional side view 7—7 of the coin receiver 60 of FIG. 2 positioned in its place of use in receptacle assembly 88, in the view of the assembly as shown in FIG. 6. FIG. 7 shows in more detail how movable bars 74 are forced from lower ledges 84, as coin receiver 60 is moved to the right, along the upper perimeter of coins 70 so that the movable bars thereby avoid contact with blocking shoulders 76. During the process of avoidance, coins 70, which are located in coin slots 72, are prevented from leaving the coin receiver 60 by retaining block 80.

Figure 8:
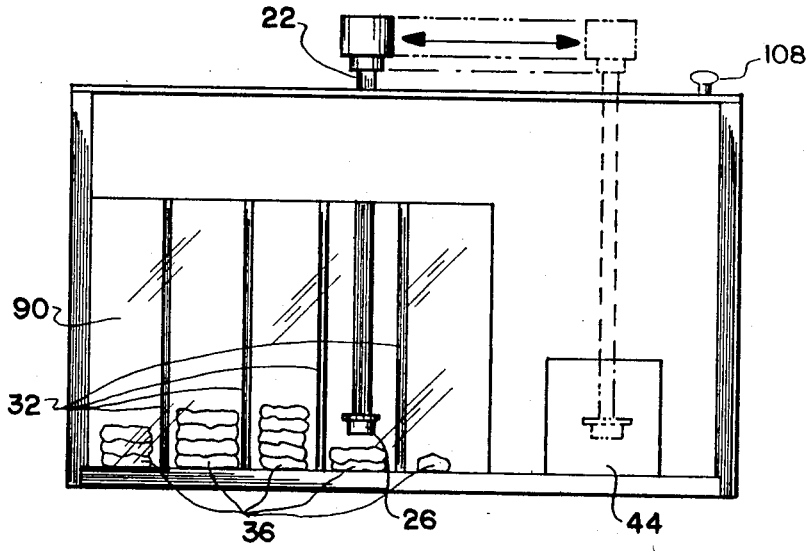
FIG. 8 is a front elevation of the vending machine of the invention.

FIG. 8 shows an external front elevation view of the vending device of the invention in which rod 22 has entered the storage bin area 34 and has been lowered over articles 36, preparatory to being adhered to one of the articles by means of the adhesive pad 26. After adherence has been achieved, the rod 22 will be raised until the rod, and an article 36 adhering to it, can be moved over bin partitions 32, enabling it to be transported to the accessable area 44 where the article is removed. The area of the vending device immediately in front of the storage bins 34 is covered with a transparent shield 90, such as glass or plastic, which permits the rod 22 to be visually guided into adhering contact with the article 36 selected, and prevents access into the storage bins other than by means of the rod.

Figure 9:
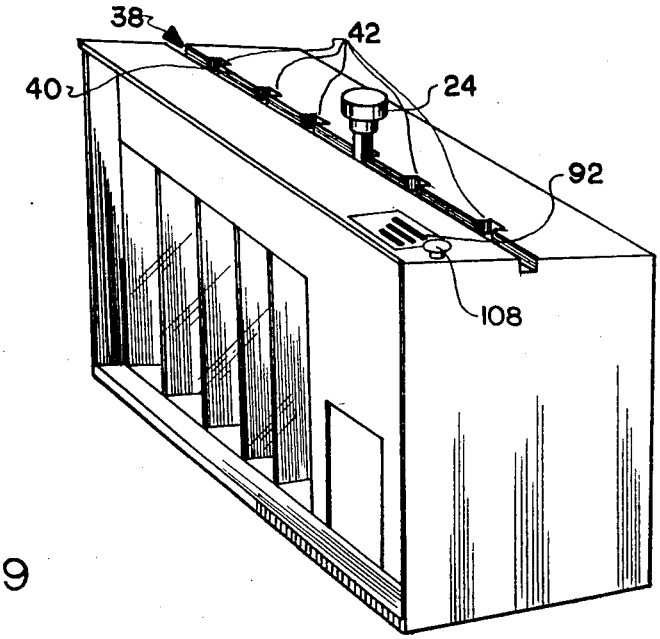
FIG. 9 is a perspective view of the vending machine of the invention.

FIG. 9, the external perspective view of the vending device, shows the knob 24 which the purchaser grasps to operate the rod 22 of the device, as well as transfer slot 38 along which the rod is guided between rails 40. Also shown are the cut-outs 42 which permit the rod 22 to be lowered into the bins, and the coin insert slot plate 92 through which coins 70 are introduced into the coin receiver 60. Desirably, the coin insert slot plate is fastened so that it can be removed and replaced with a substitute plate having a different coin slot arrangement if a price change is desired.

Figure 10:
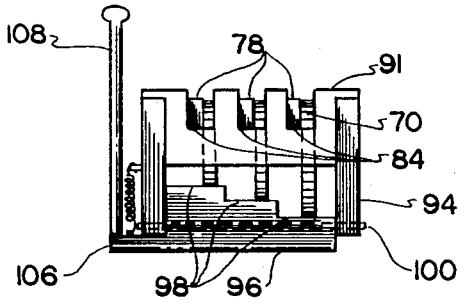
FIG. 10 is an end view of an alternative coin receiver positioned in a receptacle assembly equipped with a coin return mechanism.
Figure 11:
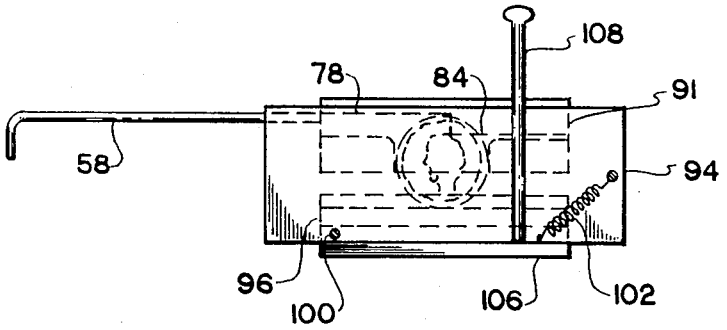
FIG. 11 is a side view of the coin receiver and receptacle assembly of FIG. 10.

FIGS. 10 and 11 show a variation 91 of the coin receiver of the invention, disposed in a receptacle assembly 94, with coins 70 inserted therein. The coin receiver 92 differs from coin receiver 60 in that both the upper 78, and lower 84 ledges of coin receiver 92 are the same height. Accommodation of coins of different sizes is made possible through use of retaining block 96 which is provided with stepped ledges 98 of different heights on which the coins 70 rest.

Retaining block 96 may be exchanged for a retaining block having stepped ledges 98 of different heights, thereby accommodating different sized coins, by removing pin 100 which holds one end of the block in place, substituting the new block and reinserting the pin.

The other end of the retaining block 96 is held in place by spring 102 one end of which is secured to a protruding edge 106 of the block, and one end of which is secured to the receptacle assembly 94. Block 96 may be swiveled downward, at an angle, with pin 100 acting as the pivot point, when push rod 108 is depressed, allowing the coins to roll off shelves 98 and thus fall into accessable area 44. The push rod 108 of the coin return mechanism, which projects from the top of the vending machine, is activated whenever an operator of the machine wishes to receive deposited coins back, without making a purchase.

If desired, the coin return type retaining block described may be substituted for the retaining block 80 of coin receiver 60.

Adhesives useful in the invention comprise that group of adhesives known as pressure sensitive adhesives, which may be placed in adhering contact with an object by the application of force, and subsequently separated in the same manner. Such substances are commonly used to coat tapes, labels and in many other areas where temporary adhering contacts are required. After prolonged use, the adhesive qualities of such substances may tend to dissipate, whereupon in the device of the invention, the adhesive pad 26 is simply detached from disc 28 and a new pad attached thereto by means of a screw, interlocking shapes of the two components, or in any other of the well known methods for fastening objects to each other.

Although the vending device is most useful for dispensing packaged articles such as candy, cigarettes, chewing gum and the like, it can be used to dispense any article having a surface adapted to be adheringly contacted by the adhesive pad 26.

While in accordance with the patent statutes, a preferred embodiment and best mode of the invention have been presented, the scope of the invention is not limited thereto, but rather is measured by the scope of the attached claims.

What is claimed is:

1. A coin-operated, manually manipulated vending machine device comprising:

a plurality of limited access article storage bins;

retrieval means for removing articles from said bins by adhesion with a pressure-sensitive adhesive and dispensing said articles;

retrieval release means for rendering said retrieval means inoperable until predetermined coins are inserted in the device;

a housing for components of said device, wherein access to said storage bins by an operator of the device is only possible through use of said means retrieval comprising a rod having said pressure-sensitive adhesive disposed on the bottom thereof, said rod being capable of being transferred to, and lowered into said storage bins and into contact with said articles so that the articles adhere to said adhesive, and said rod being capable of subsequent removal from said bin and transfer to an area of the device where the operator can access the rod and remove the articles therefrom, and wherein said rod can only reach said storage bins by being manually propelled along a rod slot, passage along which is controlled by said retrieval release means that only permits rod passage if predetermined coins have been inserted into the device, and prevents passage if they have not been so inserted.

2. A device according to claim 1 in which said retrieval release means comprises a rotatable member having two rod slot obstructing projections extending therefrom, said projections being positioned on said member so that only one of the projections can obstruct the rod slot at a time, said member being rotatable after predetermined coins are inserted in a coin receiver operably connected to said member, rotation of said member being achieved by pressure of the rod against the first of said projections as the rod is moved along the rod slot to an article storage bin, thereby rotating said first projection to a rod slot unobstructing position and permitting passage of the rod while simultaneously rotating the second projection into a rod slot obstructing position, said first projection being rotatably returned to a rod slot obstructing position by pressure of the rod against said second projection as the rod is moved back along the rod slot to an area accessible to the operator, thereby also returning said second projection to a rod slot unobstructing position.

3. A device according to claim 2 in which said coin receiver comprises an object having one or more coin slots, each of which is located adjacent to a ledged part having an upper and a lower ledge, said lower ledge being at least as high as about half the diameter of the inserted coin and said upper ledge being no higher than about the diameter of the inserted coin, and having a blocking shoulder formed at the point of transition from the lower ledge to the upper ledge, which object has associated therewith a movable bar for each coin slot, one end of each such bar being positioned to rest on said ledged part and capable of moving either up or down, said object being provided with means for operable connection to said rotatable member and capable of movement back and forth on top of a retaining block, said coin receiver operating so that when all the coins slots have not been filled with predetermined coins, movement of the receiver in the direction of the lower ledge, induced by corresponding movement of the rotatable member, is prevented by contact of at least one of said movable bars with its corresponding blocking shoulder; however, when such coins have been inserted, the movable bars resting on the lower ledges are capable of riding up and over the coins' perimeters onto the upper ledges, thereby avoiding the blocking shoulders and allowing movement of the coin receiver in the direction of the lower ledges, and when the coin slots of the coin receiver move past the edge of said retaining block, the coins are free to fall from said coin slots.

4. A coin released operating mechanism comprising a coin receiver which consists of an object having one or more coin slots, each of which is located adjacent to a ledged part having an upper and a lower ledge, said lower ledge being at least as high as about half the diameter of the inserted coin and said upper ledge being no higher than about the diameter of the inserted coin, and having a blocking shoulder formed at the point of transition from the lower ledge to the upper ledge, which object has associated therewith a movable bar for each coin slot, one end of each such bar being positioned to rest on said ledged part and capable of moving either up or down, said object being provided with means for operable connection to a component to be operated and capable of movement back and forth on top of a retaining block, said coin receiver operating so that when all the coin slots have not been filled with predetermined coins, movement of the receiver in the direction of the lower ledge is prevented by contact of at least one said movable bars with its corresponding blocking shoulder; however, when such coins have been inserted, the movable bars resting on the lower ledges are capable of riding up and over the coin's perimeters onto the upper ledges, thereby avoiding the blocking shoulders and permitting movement of the coin receiver in the direction of the lower ledges, wherein when the coin slots of the coin receiver move past the edge of said retaining block, the coins are free to fall through said coin slots, and wherein said coin receiver is slidably disposed in a receptacle assembly, said receptacle assembly having said retaining block removably attached thereto on a bottom portion of said receptacle assembly, and wherein further, said retaining block is attached on one of its ends by means of a pin to said receptacle assembly, and attached to said receptacle assembly on the other of its ends by means of a spring, said retaining block having the capability of being pivoted downward at the spring end by a force applied to said retaining block by means of a push rod associated therewith.

5. A coin released operating mechanism comprising a coin receiver which consists of an object having one or more coin slots, each of which is located adjacent to a ledged part having an upper and a lower ledge, said lower ledge being at least as high as about half the diameter of the inserted coin and said upper ledge being no higher than about the diameter of the inserted coin, and having a blocking shoulder formed at the point of transition from the lower ledge to the upper ledge, which object has associated therewith a movable bar for each coin slot, one end of each such bar being positioned to rest on said ledged part and capable of moving either up or down, said object being provided with means for operable connection to a component to be operated and capable of movement back and forth on top of a retaining block having an upper surface which varies in height across the face thereof, said coin receiver operating so that when all the coin slots have not been filled with predetermined coins, movement of the receiver in the direction of the lower ledge is prevented by contact of at least one of said movable bars with its corresponding blocking shoulder; however, when such coins have been inserted, the movable bars resting on the lower ledges are capable of rising up and over the coins' perimeters onto the upper ledges, thereby avoiding the blocking shoulders and permitting movement of the coin receiver in the direction of the lower ledges, wherein when the coin slots of the coin receiver move past the edge of said retaining block, the coins are free to fall through said coin slots, and wherein the upper surface of said retaining block varies in height so that the top of each coin resting thereon is at least as high as said upper ledge, and wherein said retaining block is removably attached to a receptacle assembly so that the denominations of coins required to operate the mechanism can be changed by replacing said retaining block with another retaining block having an upper surface different from the upper surface of the replaced block, which varies in height across the face thereof so as to accomodate the changed coin denominations.

* * * * *